US012789323B2

(12) United States Patent
Ramanath et al.

(10) Patent No.: US 12,789,323 B2
(45) Date of Patent: Nov. 10, 2026

(54) BONDED ABRASIVE ARTICLES AND METHODS OF FORMING AND USE

(71) Applicants: Srinivasan Ramanath, Columbia, SC (US); Joseph E. Smith, Jr., Columbia, SC (US); Samuel Lyman Munson, IV, Columbia, SC (US)

(72) Inventors: Srinivasan Ramanath, Columbia, SC (US); Joseph E. Smith, Jr., Columbia, SC (US); Samuel Lyman Munson, IV, Columbia, SC (US)

( * ) Notice: Subject to any disclaimer, the term of this patent is extended or adjusted under 35 U.S.C. 154(b) by 0 days.

(21) Appl. No.: 18/517,740

(22) Filed: Nov. 22, 2023

(65) Prior Publication Data

US 2024/0165770 A1 May 23, 2024

Related U.S. Application Data

(60) Provisional application No. 63/427,617, filed on Nov. 23, 2022.

(51) Int. Cl.
*B24D 3/10* (2006.01)
*B24D 3/34* (2006.01)

(52) U.S. Cl.
CPC ..... *B24D 3/10* (2013.01); *B24D 3/342* (2013.01)

(58) Field of Classification Search
CPC ..... B24D 3/06; B24D 3/10; B24D 3/342
See application file for complete search history.

(56) References Cited

U.S. PATENT DOCUMENTS

| | | | | |
|---|---|---|---|---|
| 5,035,723 | A | 7/1991 | Kalinowski et al. | |
| 8,715,381 | B2 | 5/2014 | Ramanath et al. | |
| 9,254,553 | B2 | 2/2016 | Ramanath et al. | |
| 2004/0221515 | A1 | 11/2004 | McArdle et al. | |
| 2010/0159806 | A1* | 6/2010 | Wu | C09K 3/1418 451/28 |

(Continued)

OTHER PUBLICATIONS

International Search Report and Written Opinion of the International Searching Authority, mailed Mar. 13, 2024, for corresponding International Application No. PCT/2023/080935.

*Primary Examiner* — Pegah Parvini
(74) *Attorney, Agent, or Firm* — Todd A. Serbin; Maynard Nexsen PC

(57) ABSTRACT

An abrasive article comprising: a body comprising abrasive grains contained within a bond material comprising a metal or metal alloy, wherein the body comprises a ratio, ($V_{AG}$/$V_{BM}$), of volume of abrasives ($V_{AG}$) to volume of bond ($V_{BM}$), of between about 0.127 and about 1.27, wherein ($V_{AG}$) is a volume percent of abrasive grains within the total volume of the body, ($V_{BM}$) is the volume percent of bond within the total volume of the body, wherein the body could have about 15% to about 55% porosity, more preferably about 20% to about 55% and most preferably 25% to 55% porosity, wherein the bond material comprises at least 1% of an active bond composition of the total volume of the bond, a portion of which is at the interface of the abrasive grains and the bond material.

26 Claims, 4 Drawing Sheets

(56) References Cited

U.S. PATENT DOCUMENTS

| | | | | |
|---|---|---|---|---|
| 2012/0055098 | A1* | 3/2012 | Ramanath | B24D 3/14 51/309 |
| 2014/0187123 | A1 | 7/2014 | Ramanath et al. | |

* cited by examiner

BONDED ABRASIVE ARTICLES AND METHODS OF FORMING AND USE

RELATED APPLICATION

This application claims the benefit of priority under 35 U.S.C. § 119(e) of U.S. Provisional Patent Application No. 63/427,617 filed Nov. 23, 2022, the contents of which are incorporated herein by reference in their entirety.

FIELD OF THE INVENTION

The following is directed bonded abrasive articles, and more particularly, bonded abrasive articles including abrasive grains contained within a bond material including a metal or metal alloy.

BACKGROUND OF THE INVENTION

Abrasives used in machining applications typically include bonded abrasive articles and coated abrasive articles. Coated abrasive articles are generally layered articles having a backing and an adhesive coat to fix abrasive grains to the backing, the most common example of which is sandpaper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus.

Bonded abrasive tools usually have at least two phases including abrasive grains and bond material. Certain bonded abrasive articles can have an additional phase in the form of porosity. Bonded abrasive tools can be manufactured in a variety of 'grades' and 'structures' that have been defined according to practice in the art by the relative hardness and density of the abrasive composite (grade) and by the volume percentage of abrasive grain, bond, and porosity within the composite (structure).

Some bonded abrasive tools may be particularly useful in grinding and shaping certain types of workpieces, including for example, metals, ceramics and crystalline materials, used in the electronics and optics industries. In other instances, certain bonded abrasive tools may be used in shaping of superabrasive materials for use in industrial applications. In the context of grinding and shaping certain workpieces with metal-bonded abrasive articles, generally the process involves a significant amount of time and labor directed to maintaining the bonded abrasive article. That is, generally, metal-bonded abrasive articles require regular truing and dressing operations to maintain the grinding capabilities of the abrasive article.

The industry continues to demand improved methods and articles capable of grinding. It is well established that increasing porosity aids in more efficient grinding wheel by providing a space for the grinding debris to go to and improved application of grinding fluid. Grinding wheels using metal or metal alloys for bond and abrasives for grinding contain a reduced amount of porosity such as 20% or less. This is due to the shrinkage that takes place during thermal sintering process. U.S. Pat. Nos. 8,715,381 and 9,254,553 try to overcome this shrinkage by having a high abrasive to bond ratio by volume or abrasive plus filler to bond ratio by volume, such as over 1.3 and 1.5 respectively. The abrasives or abrasives plus filler act as a skeleton preventing the shrinkage during thermal processing and end up with around 40% porosity. This reduces the amount of bond and the strength of the abrasive composite. If there is a way to create the high porosity while having a high bond content or low abrasive-bond ratios, one could get the best of both worlds. Surprisingly, certain metals and metal alloys when processed with abrasives result in high porosity structures. When they include active metals such as titanium which bonds chemically to the abrasives, the structure also possesses sufficient strength.

SUMMARY OF THE INVENTION

According to an aspect of some embodiments of the present invention there is provided an abrasive article comprising: a body comprising abrasive grains contained within a bond material comprising a metal or metal alloy, wherein the body comprises a ratio, ($V_{AG}/V_{BM}$), of volume of abrasives ($V_{AG}$) to volume of bond ($V_{BM}$), of between about 0.127 and about 1.27, wherein ($V_{AG}$) is a volume percent of abrasive grains within the total volume of the body, ($V_{BM}$) is the volume percent of bond within the total volume of the body, wherein the body could have about 15% to about 55% porosity, more preferably about 20% to about 55% and most preferably 25% to 55% porosity, and, wherein the bond material comprises at least 1% of an active bond composition of the total volume of the bond, a portion of which is at the interface of the abrasive grains and the bond material.

In an embodiment of the invention, the active bond composition comprises a compound containing titanium, zirconium, chromium, tungsten, silicon or a combination thereof.

In an embodiment of the invention, a portion of the active bond composition within the bond material surrounds the abrasive grains at the interface between the abrasive grains and the bond material.

In an embodiment of the invention, the abrasive grains comprise an inorganic material selected from the group of materials consisting of carbides, oxides, nitrides, and a combination thereof.

In an embodiment of the invention, the abrasive grains comprise a superabrasive material such as diamond and cubic boron nitride.

In an embodiment of the invention, abrasive grains have an average grit size of not greater than 2500 microns, more preferably not greater than 2000 microns and most preferably not greater than 1500 microns.

In an embodiment of the invention, abrasive grains have an aspect ratio of not greater than about 3:1, wherein aspect ratio is defined as a ratio of the dimensions, length:width.

In an embodiment of the invention, the ratio ($V_{AG}/V_{BM}$), is within a range between about 0.127 and about 1.27, more preferably about 0.5 and about 1.27 and most preferably about 0.75 and about 1.27.

In an embodiment of the invention, The bond system of abrasive article comprises one or more metals and/or metal alloys.

In an embodiment of the invention, The bond system of abrasive article could also comprise inter-metallics.

In an embodiment of the invention, the bond material comprises an average fracture toughness ($K_{1C}$) of not greater about 30.0 MPa m0.5.

In an embodiment of the invention, the body comprises fillers and wherein the body comprises a ratio ($V_P/V_{BM}$), is about 0.15 and 1.45, more preferably about 0.5 and 1.45 and most preferably about 0.5 and 1.25. wherein $V_P$, is a volume percent of particulate material including abrasive grains and fillers within a total volume of the body and $V_{BM}$ is a volume percent of bond material within the total volume of the body.

In an embodiment of the invention, the fillers comprise a material selected from the group of materials consisting of oxides, carbides, borides, silicides, nitrides, oxynitrides, silicates, graphite, silicon, ceramics, hollow-ceramics, fused silica, glass, glass-ceramics, hollow glass spheres, and a combination thereof.

In an embodiment of the invention, a majority of the porosity is interconnected porosity defining a network of interconnected pores extending through the volume of the body.

In an embodiment of the invention, the abrasive grains comprise a coating.

In an embodiment of the invention, the coating comprises a metal or metal alloy.

In an embodiment of the invention, the coating includes an electroplated metal layer applied to the abrasive grains.

In an embodiment of the invention, the fillers comprise not greater than about 50 vol % of the total volume of the body.

According to a further aspect of some embodiments of the present invention there is provided an abrasive article comprising: a body comprising abrasive grains and fillers contained within a bond material comprising a metal or metal alloy, wherein the body comprises a ratio ($V_P/V_{BM}$) between 0.127 and about 1.47, wherein $V_P$, is a volume percent of particulates present within the total volume of the body, and $V_{BM}$, is the volume percent of bond within the total volume of the body, wherein the body could have about 15% to about 55% porosity, more preferably about 20% to about 55% and most preferably 25% to 55% porosity, wherein the bond material comprises at least 1% of an active bond composition of the total volume of the bond, a portion of which is at the interface of the abrasive grains and the bond material, and wherein the particulates include the abrasive grains and fillers combined.

In an embodiment of the invention, the fillers could be hard materials such as oxides, borides, nitrides, carbides, silicides of metals and non-metals, soft materials such as graphite, hollow materials such as hollow glass or ceramic spheres, and amorphous materials such as glass.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof.

BRIEF DESCRIPTION OF THE SEVERAL VIEWS OF THE DRAWING(S)

Some embodiments of the invention are herein described, by way of example only, with reference to the accompanying drawings and/or images. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

The following is generally directed to bonded abrasive articles incorporating abrasive grains within a three-dimensional matrix of material. Bonded abrasive articles utilize a volume of abrasive grains secured within a three-dimensional matrix of bond material. Moreover, the following includes description related to methods of forming such bonded abrasive articles.

Figure 1:
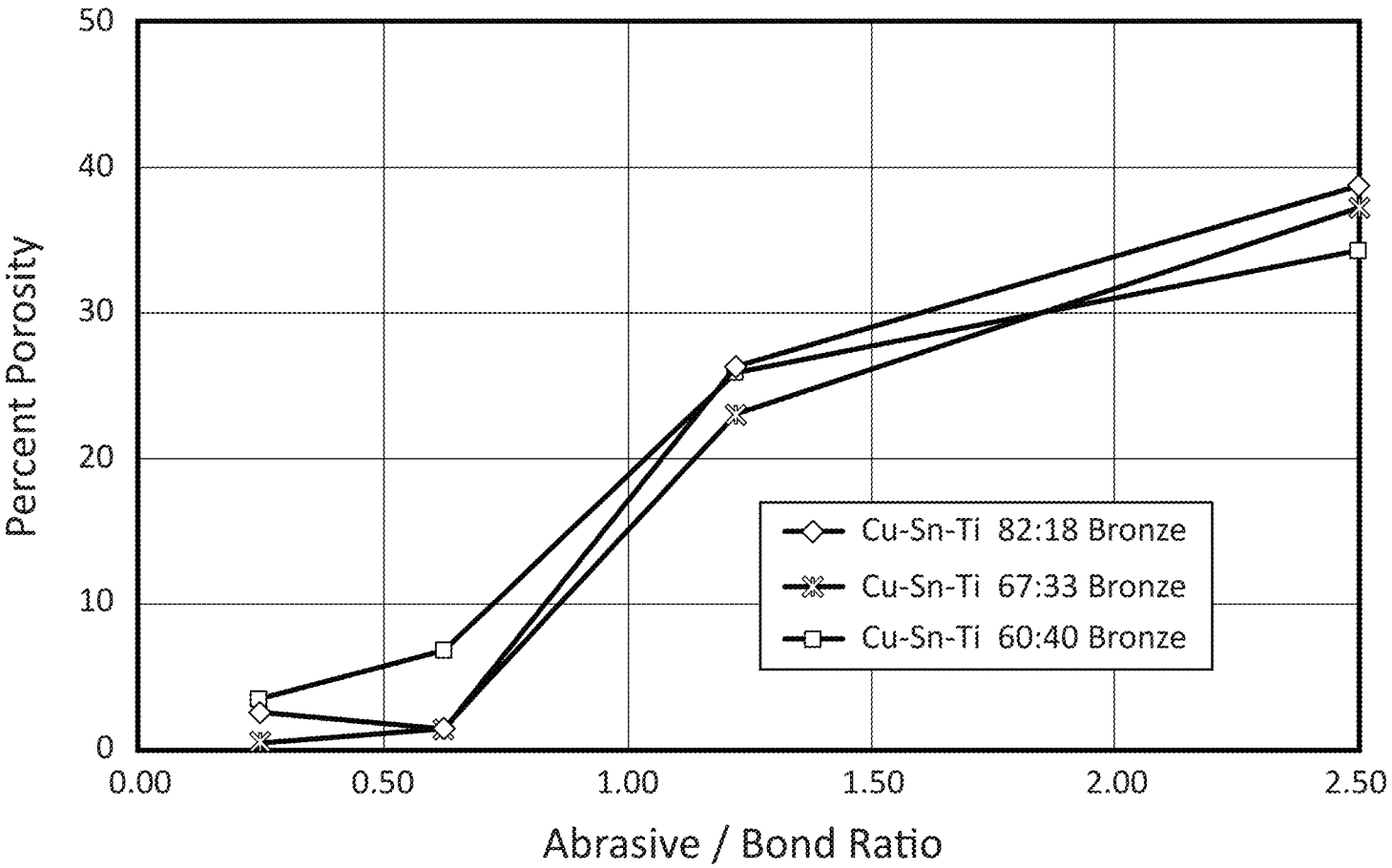
FIG.1 Prior Art
FIG. 1 is a graph showing percent porosity in a simple bronze-titanium system as a function of abrasive/bond ratios.

In prior patents such as U.S. Pat. Nos. 8,715,381 and 9,254,553 high porosities are achieved through the use of high abrasive concentration and low bond content. The latter patent uses a filler to take the place of some of the abrasives. In both cases, use of high abrasives and/or fillers prevent the structure from shrinking during furnacing at a high temperature. The ratios of abrasive to bond or abrasives plus filler to bond is above 1.3 and 1.5 respectively. Test bars of different compositions were made, as shown in Table 1. When a metal bond system as in prior art is made with less than 1.3 ratio, the porosity drops drastically as shown in FIG. 1. FIG. 1 shows percent porosity in a simple bronze-titanium system as a function of abrasive/bond ratios. With decreasing abrasive content, the sample shrinks leading to reduced or no porosity. All samples have been sintered in a vacuum furnace at a temperature high enough to cause liquid phase sintering.

This drastic drop in porosity, as shown in FIG. 1, is due to shrinking of the metal alloy system due to liquid phase sintering at high temperatures. Shrinkage leads to reduced porosity in such test bars. The samples shown in FIG. 1 were made with diamond abrasive grit of size US mesh 200/230 and type MB150, which is considered to be a fine size. Regardless of the copper to tin ratio, the porosity drops with decreasing abrasive/bond ratios such as 1.3 and below. If a grinding wheel with similar composition were made, it would result in similar reduced porosity levels. Such a wheel with reduced porosity would not grind efficiently. The spindle power consumed on the grinding machine, which is a metric of wheel performance would be higher than a wheel with low porosity.

Similar results were obtained using a nickel-chromium-phosphorous metal alloy system for bond and US mesh 70/80 for diamond when the abrasive bond content was below 1.3. Porosity decreased substantially when abrasive/bond ratio was below 1.3.

However, when both metal alloys were mixed in different proportions as shown in Table 1 in an embodiment of this invention, the porosity values did not drop significantly and remained above 30% at below 1.3 abrasive/bond ratios. This was an unexpected surprise.

In another embodiment of the invention, when nickel-chromium-phosphorous metal alloy was added to tungsten metal, the porosity values remained high at low abrasive/bond ratios. This was also an unexpected result.

In another embodiment of the invention a copper-tin-titanium metal alloy system was mixed with 316L stainless steel metal alloy and made into test bar. The porosity in such abrasive compacts remained at above 40% even at low abrasive/bond ratios. This points to the fact that there are certain family of metals and metal alloys that could result in high porosity values.

In another embodiment of this invention, some of the abrasives were replaced with fillers and similar results of high porosities were noted at low abrasive plus filler over bond ratios.

In accordance with an embodiment, the process for forming an abrasive article can be initiated by forming a mixture containing abrasive grains and bond material. The abrasive grains can include a hard material. For example, the abrasive grains can have a Mohs hardness of at least about 7. In other abrasive bodies, the abrasive grains can have a Mohs hardness of at least 8, or even at least 9.

In particular instances, the abrasive grains can be made of an inorganic material. Suitable inorganic materials can include carbides, oxides, nitrides, borides, oxycarbides, oxyborides, oxynitrides, and a combination thereof. Particular, examples of abrasive grains include silicon carbide, boron carbide, alumina, zirconia, alumina-zirconia composite particles, silicon nitride, SiAlON, and titanium boride. In certain instances, the abrasive grains can include a super-abrasive material, such as diamond, cubic boron nitride, and a combination thereof. In particular instances, the abrasive grains can consist essentially of diamond. In other embodiments, the abrasive grains can consist essentially of cubic boron nitride.

The abrasive grains can have an average grit size of not greater than about 1200 microns. In other embodiments, the abrasive grains can have an average grit size of not greater than about 750 microns, such as not greater than about 500 microns, not greater than about 250 microns, not greater than about 200 microns, or even not greater than about 150 microns. In particular instances, the abrasive grains of embodiments herein can have an average grit size, within a range between about 1 micron and about 1200 microns, such as between about 1 micron and 500 microns, or even between about 1 micron and 200 microns.

In further reference to the abrasive grains, the morphology of the abrasive grains can be described by an aspect ratio, which is a ratio between the dimensions of length to width. It will be appreciated that the length is the longest dimension of the abrasive grit, and the width is the second longest dimension of a given abrasive grit. In accordance with embodiments herein, the abrasive grains can have an aspect ratio (length:width) of not greater than about 3:1 or even not greater than about 2:1. In particular instances, the abrasive grains can be essentially equiaxed, such that they have an aspect ratio of approximately 1:1.

The abrasive grains can include other features, including for example, a coating. The abrasive grains can be coated with a coating material which may be an inorganic material. Suitable inorganic materials can include a ceramic, a glass, a metal, a metal alloy, and a combination thereof. In particular instances, the abrasive grains can be electroplated with a metal material and, more particularly, a transition metal composition. Such coated abrasive grains may facilitate improved bonding (e.g., chemical bonding) between the abrasive grains and the bond material.

In certain instances, the mixture can include a particular distribution of abrasive grains. For example, the mixture can include a multi-modal distribution of grit sizes of abrasive grains, such that a particular distribution of fine, intermediate, and coarse grit sizes is present within the mixture. In one particular instance the mixture can include a bimodal distribution of abrasive grains including fine grains having a fine average grit size and coarse abrasive grains having a coarse average grit size, wherein the coarse average grit size is significantly greater than the fine average grit size. For instance, the coarse average grit size can be at least about 10% greater, at least about 20%, at least about 30%, or even at least about 50% greater than the fine average grit size (based on the fine abrasive grit size). It will be appreciated that the mixture can include other multi-modal distribution of abrasive grains, including for example, a tri-modal distribution or a quad-modal distribution.

It will also be appreciated that abrasive grains of the same composition can have various mechanical properties, including for example, friability. The mixture, and the final-formed bonded abrasive body, can incorporate a mixture of abrasive grains, which may be the same composition, but having varied mechanical properties or grades. For example, the mixture can include abrasive grains of a single composition, such that the mixture includes only diamond or cubic boron nitride.

However, the diamond or cubic boron nitride can include a mixture of different grades of diamond or cubic boron nitride, such that the abrasive grains having varying grades and varying mechanical properties.

The abrasive grains can be provided in the mixture in an amount such that the finally formed abrasive article contains a particular amount of abrasive grains.

In accordance with an embodiment, the bond material could comprise of a metal or metal alloy material. For example, the bond material can include a powder composition including at least one transition metal element. In particular instances, the bond material can include a metal selected from the group including copper, tin, silver, molybdenum, zinc, tungsten, iron, nickel, antimony, and a combination thereof. In one particular embodiment, the bond material can be a metal alloy including copper and tin. The metal alloy of copper and tin can be a bronze material, which may be formed of a 60:40 by weight composition of copper and tin, respectively.

According to a particular embodiment, the metal alloy of copper and tin can include a certain content of copper, such that the final-formed bonded abrasive article has suitable mechanical characteristics and grinding performance. For example, the copper and tin metal alloy can include not greater than about 90% copper, such as not greater than about 65% copper, not greater than about 60% not greater than about 50% copper, not greater than about 45% copper, or even not greater than about 40% copper. In particular instances, the amount of copper is within a range between about 30% and about 65%, and more particularly, between about 40% and about 65%.

Certain metal alloys of copper and tin can have a minimum amount of tin. For example, the metal alloy can include at least about 30% tin of the total amount of the composition. In other instances, the amount of tin can be greater, such as at least about 35%, at least about 40%, at least about 45%, at least about 50%, at least about 60%, at least about 65%, or even at least about 75%. Certain bond materials can include a copper and tin metal alloy having an amount of tin within a range between about 30% and about 80%, between about 30% and about 70%, or even between about 35% and about 65%.

Metal alloys could also include those that preferably bond chemically, with the metals used. Some examples used include cast iron, stainless steel, bronze, brass, Inconel, hard facing alloys, braze alloys, welding alloys, 3d printing alloys, self-fluxing alloys and bimetallic strips. These metal alloys could comprise of copper, tin, nickel, iron, chromium, tungsten, cobalt, tungsten, molybdenum, vanadium, silver, aluminum and zinc. Metal alloys could also be used by themselves, without addition of metals.

In an alternative embodiment, the bond material can be a tin-based material, wherein tin-based materials include metal and metal alloys comprising a majority content of tin versus other compounds present in the material. For example, the bond material can consist essentially of tin. Still, certain-tin-based bond materials may be used that include not greater than about 10% of other alloying materials, particularly metals.

The mixture can contain an equal portion of abrasive grains to bond. However, in certain embodiments, the mixture can be formed such that the amount of bond material can be more than or less than the amount of abrasive grains within the mixture. Such a mixture facilitates a bonded abrasive article having certain properties, which are described in more detail herein.

In addition to the abrasive grains and bond material, the mixture can further include an active bond composition precursor. The active bond composition precursor includes a material, which can be added to the mixture that later facilitates a chemical reaction between certain components of the bonded abrasive body, including for example, particulate material (e.g., abrasive grains and/or fillers) and bond material.

The active bond composition precursor can be added to the mixture in minor amounts, and particularly, in amounts less than the amount of the abrasive grains present within the mixture.

In accordance with an embodiment, the active bond composition precursor can include a composition including a metal or metal alloy. More particularly, the active bond composition precursor can include a composition or complex including hydrogen. For example, the active bond composition precursor can include a metal hydride, and more particularly, can include a material such as titanium hydride. In one embodiment, the active bond composition precursor consists essentially of titanium hydride.

The mixture generally includes a minor amount of the active bond composition precursor. For example, the mixture can include not greater than about 40 wt % of the active bond composition precursor of the total weight of the mixture. In other embodiments, the amount of the active bond composition precursor within the mixture can be less, such as not greater than about 35 wt %, not greater than about 30 wt %, not greater than about 28 wt %, not greater than about 26 wt %, not greater than about 23 wt %, not greater than about 18 wt %, not greater than about 15 wt %, not greater than about 12 wt %, or even not greater than about 10 wt %. In particular instances, the amount of active bond composition precursor within the mixture can be within a range between about 2 wt % and about 40 wt %, such as between about 4 wt % and about 35 wt % between about 8 wt % and about 28 wt %, between about 10 wt % and about 28 wt % or even between about 12 wt %, and about 26 wt %.

The mixture can further include a binder material. The binder material may be utilized to provide suitable strength during formation of the bonded abrasive article. Certain suitable binder materials can include an organic material. For example, the organic material can be a material such as a thermoset, thermoplastic, adhesive and a combination thereof. In a particular instance, the organic material of the binder material includes a material such as polyimides, polyamides, resins, aramids, epoxies, polyesters, polyurethanes, acetates, celluloses, and a combination thereof. In one embodiment, the mixture can include a binder material utilizing a combination of a thermoplastic material configured to cure at a particular temperature. In another embodiment, the binder material can include an adhesive material suitable for facilitating attachment between components of the mixture. The binder can be in the form of a liquid, including for example, an aqueous-based or non-aqueous-based compound.

Generally, the binder material can be present in a minor amount (by weight) within the mixture. For example, the binder can be present in amount significantly less than the amount of the abrasive grains, bond material, or the active bond composition precursor. For example, the mixture can include not greater than about 30 wt % of binder material for the total weight of the mixture. In other embodiments, the amount of binder material within the mixture can be less, such as not greater than about 30 wt %, not greater than about 25 wt %, not greater than about 23 wt %, not greater than about 22 wt %, not greater than about 19 wt %, not greater than about 15 wt %, not greater than about 12 wt %, not greater than about 10 wt %, or even not greater than about 8 wt %. In particular instances, the amount of binder material within the mixture can be within a range between about 2 wt % and about 30 wt %, such as between about 4 wt % and about 30 wt %, between about 8 wt % and about 25 wt %, between about 10 wt % and about 23 wt %, or even between about 12 wt % and about 22 wt %.

The mixture can further include a certain amount of fillers. The fillers can be a particulate material, which may be substituted for certain components within the mixture, including for example, the abrasive grains. Notably, the fillers can be a particulate material that may be incorporated in the mixture, wherein the fillers substantially maintain their original size and shape in the finally-formed bonded abrasive body. Examples of suitable fillers can include oxides, carbides, borides, silicides, nitrides, oxynitrides, oxycarbides, silicates, graphite, silicon, inter-metallics, ceramics, hollow-ceramics, fused silica, glass, glass-ceramics, hollow glass spheres, natural materials such as shells, and a combination thereof.

Notably, certain fillers can have a hardness that is less than the hardness of the abrasive grains. Additionally, the mixture can be formed such that the fillers are present in an amount of not greater than about 90 vol % of the total volume of the mixture. Volume percent is used to describe the content of fillers as fillers can have varying density depending upon the type of particulate, such as hollow spheres versus heavy particulate. In other embodiments, the amount of filler within the mixture can be not greater than about 80 vol %, such as not greater than about 70 vol %, not greater than about 60 vol %, not greater than about 50 vol %, not greater than about 40 vol %, not greater than about 30 vol %, or even not greater than about 20 vol %.

Certain forming processes may utilize a greater amount of filler material than the abrasive grains. For example, most of the abrasive grains can be substituted with one or more filler materials. In other instances, a majority content of the abrasive grains can be substituted with filler material. In other embodiments, a minor portion of the abrasive grains can be substituted with filler material.

Moreover, the fillers can have an average particulate size that is significantly less than the average grit size of the abrasive grains. For example, the average particulate size of the fillers can be at least about 5% less, such as at least about 10% less, such as at least about 15% less, at least about 20% less, or even at least about 25% less than the average grit size of the abrasive grains based on the average grit size of the average grit size of the abrasive grains.

In certain other embodiments, the fillers can have an average particulate size that is greater than the abrasive grains, particularly in the context of fillers that are hollow bodies.

In order to demonstrate the unexpected results, test bars of nominal size 2.05"×0.323"×0.125" (check size) were made of different compositions. For the sake of completeness, when a metal or metal alloy is heated in a controlled atmosphere or vacuum to a high enough temperature preferably at liquid phase, they would shrink and densify. We have shown this to be true in two commonly used braze systems, bronze/titanium and nickel-chromium-phosphorous. However, when the two systems are mixed, there is a lot less shrinkage and high porosity desirable in efficient grinding wheels. We have also shown that addition of other metals or alloys in one or the other of the two systems could have the same effect. Test data using diamond and cubic boron nitride were produced. A wide range of abrasive to bond ratios were covered and we plan to claim areas outside of prior art. It is also possible to have fillers in such systems and be outside the corresponding values in prior art.

After forming a mixture of abrasives, fillers (if any), bond powder, and binder, the process of forming the bonded abrasive article continues by shearing the mixture such that it has proper rheological characteristics. For example, the mixture can be sheared until it has a particular viscosity, such as at least about 100,000 Centipoise, and can have a consistency that is semi-liquid (e.g., a mud-like consistency). In other instances, it could be of much lower viscosity such as a paste.

After shearing the mixture, the process can continue by forming agglomerates from the mixture. Process of forming agglomerates can initially include a process of drying the mixture. In particular the drying process may be conducted at a temperature suitable to cure an organic component (e.g., thermoset) within the binder contained within the mixture, and remove a portion of certain volatiles (e.g., moisture) within the mixture. Thus, upon suitable curing the organic material within the binder material, the mixture can have a hardened or semi-hardened form. Particularly suitable drying temperatures can be not greater than about 250° C., and more particularly, within a range between about 0° C. and about 100° C.

After drying the mixture at a suitable temperature, the process of forming agglomerates can continue by crushing the hardened form. After crushing the hardened form, the crushed particles include agglomerates of the components contained within the mixture, including the abrasive grains and bond material. The process of forming the agglomerates can then include sieving of the crushed particulate to obtain a suitable distribution of agglomerate sizes. Both test bars and grinding wheels were made in a similar manner.

After forming the agglomerates, the process can continue by shaping the agglomerates into a desirable shape of the finally-formed bonded abrasive article. One suitable shaping process includes filling a mold with the agglomerated particles. After filling the mold, the agglomerates can be pressed to form a green (i.e., unsintered) body having the dimensions of the mold. In accordance with one embodiment, pressing can be conducted at a pressure of at least about 10 lbs./in$^2$ of the area of the bonded abrasive article. In other embodiments, the pressure can be greater, such as on the order of at least about 100 lbs./in$^2$, at least about 1000 lbs./in$^2$, at least about 2000 lbs./in$^2$, or even at least about 4000 lbs./in$^2$. In one particular embodiment pressing is completed at a pressure within a range between about 10 lbs./in$^2$ and about 10000 lbs/in$^2$, or more particularly, within a range between about 10 lbs./in$^2$ and about 6000 lbs/in$^2$.

The presses required could be sufficiently small such as an arbor press instead of a mechanical press which can be expensive. Most abrasive products are pressed using a mechanical press and the use of arbor press at low pressures is a novelty, made possible through high bond content. Pressing at lower pressures generally means more porosity in the structure before and after furnacing. Having more bond helps in providing the strength needed even with more porosity.

After shaping the mixture to form the green article, the process can continue by treating the green article. Treating can include heat treating the green article, and particularly sintering of the green article. In a particular embodiment, treating includes liquid phase sintering to form the bonded abrasive body. Notably, liquid phase sintering includes forming a liquid phase of certain components of the green article, particularly, the bond material, such that at the sintering temperature at least a portion of the bond material is present in liquid phase and free-flowing. Notably, liquid phase sintering is not a process generally used for formation of bonded abrasives utilizing a metal bond material. It is usually carried out in solid phase sintering.

In accordance with an embodiment, treating the green article includes heating the green article to a liquid phase sintering temperature of at least 400° C. In other embodiments, the liquid phase sintering temperature can be greater, such as at least 500° C., at least about 650° C., at least about 800° C., or even at least about 900° C. In particular instances, the liquid phase sintering temperature can be within a range between about 400° C. and about 1100° C., such as between about 800° C., and about 1100° C., and more particularly, within a range between about 800° C. and 1050° C.

Treating, and particularly sintering, can be conducted for a particular duration. Sintering at the liquid phase sintering temperature can be conducted for a duration of at least about 10 minutes, at least about 20 minutes, at least about 30 minutes, or even at least about 40 minutes. In particular embodiments, the sintering at the liquid phase sintering temperature can last for a duration within a range between about 10 minutes and about 90 minutes, such as between about 10 minutes and 60 minutes, or even between about 15 minutes and about 45 minutes.

Treating the green article can further include conducting a liquid phase sintering process in a particular atmosphere. For example, the atmosphere can be a reduced pressure atmosphere having a pressure of not greater than about $10^{-2}$ Torr. In other embodiments, the reduce pressure atmosphere can have a pressure of not greater than about $10^{-3}$ Torr, not greater than about $10^{-4}$ Torr, such as not greater than about $10^{-5}$ Torr, or even not greater than about $10^{-6}$ Torr. In particular instances, the reduced pressure atmosphere can be within a range between about $10^{-2}$ Torr and about $10^{-6}$ Torr.

Additionally, during treating the green article, and particularly during a liquid phase sintering process, the atmosphere can be a non-oxidizing (i.e., reducing) atmosphere. Suitable gaseous species for forming the reducing atmosphere can include hydrogen, nitrogen, noble gases, carbon monoxide, dissociated ammonia, and a combination thereof. In other embodiments, an inert atmosphere may be used during treating of the green article, to limit oxidation of the metal and metal alloy components.

The presses required could be sufficiently small such as an arbor press instead of a mechanical press which can be expensive. Most abrasive products are pressed using a mechanical press and the use of arbor press at low pressures is a novelty, made possible through high bond content. Pressing at lower pressures generally means more porosity in the structure before and after furnacing. Having more bond helps in providing the strength needed even with more porosity.

After completing the treating process, a bonded abrasive article incorporating abrasive grains within a metal bond material is formed. In accordance with an embodiment, the abrasive article can have a body having particular features. For example, in accordance with one embodiment, the bonded abrasive body can have a significantly lower volume of abrasive grains than the volume of bond material within the body. The bonded abrasive body can have a ratio of $V_{AG}/V_{BM}$ of up to about 1.27, wherein $V_{AG}$ represents a volume percent of abrasive grains within the total volume of the bonded abrasive body, and $V_{BM}$ represents the volume percent of bond material within the total volume of the bonded abrasive body. In accordance with another embodiment, the ratio of $V_{AG}/V_{BM}$ can be up to about 1.27, such as up to about 1.2, at least about 1.1, up to about 1.0, up to about 0.9, or even up to about 0.75. In other embodiments, the bonded abrasive body can be formed such that the ratio of $V_{AG}/V_{BM}$ is within a range between about 0.127 and about 1.27, such as between about 0.25 and about 1.15, such as between about 0.30 and about 1.10, such as between about 0.4 and about 1.0, or even between about 0.4 and about 0.9. The prior art (U.S. Pat. No. 8,715,381) talks about the ratio being at least about 1.3.

High porosity abrasive structures (up to 50%), having a low abrasive to bond ratios such as 0.127 to 1.27, that provide good retention of the abrasives and strength of the structure. High porosity abrasive structures using high ratios such as 1.3 and above have been demonstrated in prior art. The bond system holding the abrasives consists of metal and/or metal alloys only. Normally, use of low ratios in metal/metal alloy abrasive systems with abrasives lead to low porosity due to shrinkage of the structure during processing at high temperatures.

High porosity (up to 50%) structures that consists of abrasives and fillers and bond. The bond could once again consist of metals and metal alloys. In this case, the volume ratio of abrasive plus filler over bond could range from 0.15 to 1.47. Prior art mentions ratios ranging from 1.5 and above. The fillers comprise a material selected from the group of materials consisting of oxides, borides, silicides, nitrides, oxynitrides, silicates, graphite, silicon, ceramics, hollow-ceramics, fused silica, glass, glass-ceramics, hollow glass spheres and a combination thereof.

In more particular terms, the bonded abrasive body can include at least about 25 vol % abrasive grains for the total volume of the bonded abrasive body. In other instances, the content of abrasive grains is greater, such as at least about 45 vol %, at least about 50 vol %, at least about 60 vol %, at least about 70 vol %, or even at least about 75 vol %. In some embodiments, the bonded abrasive body comprises between about 30 vol % and about 90 vol %, such as between about 45 vol % and about 90 vol %, between about 50 vol % and about 85 vol %, or even between about 60 vol % and about 80 vol % abrasive grains for the total volume of the bonded abrasive body.

The bonded abrasive body can include not greater than about 50 vol % bond material for the total volume of the bonded abrasive body. According to certain embodiments, the content of bond material is less, such not greater than about 50 vol %, not greater than about 30 vol %, not greater than about 25 vol %, not greater than about 20 vol %, or even not greater than about 15 vol %. In particular embodiments, the bonded abrasive body comprises between about 5 vol % and about 50 vol %, such as between about 5 vol % and about 40 vol %, between about 5 vol % and about 30 vol %, or even between about 10 vol % and about 30 vol % bond material for the total volume of the bonded abrasive body.

Higher bond content permits one to furnace in marginal atmospheres at lower vacuum levels with sufficient bonding strength between abrasives and bond. When is filler is included the bonding strength between filler and bond is also adequate.

Higher bond content permits one to use metal powders that may have a higher level of oxide on their surface and still get enough strength.

In accordance with another embodiment, the bonded abrasive body herein can include a certain amount of porosity. For example, the bonded abrasive body can have at least 5 vol % porosity for the total volume of the bonded abrasive body. In other embodiments, the bonded abrasive body can have at least about 10 vol %, such as at least about 15 vol %, at least about 20 vol %, at least about 25 vol %, at least about 40 vol %, at least about 45 vol %, or even at least about 50 vol % porosity for the total volume of the body. Still, in other embodiments, the bonded abrasive body can include not greater than about 80 vol % porosity for the total volume of the body. In other articles, the bonded abrasive body can have not greater than about 70 vol %, not greater than about 60 vol %, 55 vol % porosity, such as not greater than about 50 vol % porosity, not greater than about 48 vol % porosity, not greater than about 44 vol % porosity, not greater than about 40 vol % porosity, or even not greater than about 35 vol % porosity for the total volume of the body. It will be appreciated that the porosity can fall within a range between any of the minimum and maximum values listed herein.

The bonded abrasive body can be formed such that a certain content of the porosity within the bonded abrasive body is interconnected porosity. Interconnected porosity defines a network of interconnected channels (i.e., pores) extending through the volume of the bonded abrasive body. For example, a majority of the porosity of the body can be interconnected porosity. In fact, in particular instances, the bonded abrasive body can be formed such that at least 60%, at least about 70%, at least about 80%, at least about 90%, or even at least about 95% of the porosity present within the bonded abrasive body is interconnected porosity. In certain instances, essentially all of the porosity present within the body is interconnected porosity. Accordingly, the bonded abrasive body can be defined by a continuous network of two phases, a solid phase defined by the bond and abrasive grains and a second continuous phase defined by the porosity extending between the solid phase throughout the bonded abrasive body.

In accordance with another embodiment, the bonded abrasive body can have a particular ratio of particulate material ($V_P$), which includes abrasive grains and fillers, as compared to the bond material ($V_{BM}$) for the total volume of the bonded abrasive body. It will be appreciated that the amounts of the particulate material and the bond material are measured in volume percent of the component as part of the total volume of the body. For example, the bonded abrasive body of embodiments herein can have a ratio ($V_P/V_{BM}$) of no more than about 1.47. In other embodiments, the ratio ($V_P/V_{BM}$) can be no more than about 1.25, no more than about 1.2, no more than about 1.0, no more than about 0.5, or even no more than about 0.15. In particular instances, the ratio ($V_P/V_{BM}$) can be within a range between 0.15 and about 1.47, such as between about 0.25 and 1.47, such as between about 0.5 and about 1.25, between about 0.5 and about 1.25, and between about 0.6 and about 1.0.

According to one embodiment, the abrasive body can include an amount (vol %) of fillers that can be less than, equal to, or even greater than the amount (vol %) of abrasive grains present within the total volume of the bonded abrasive body. Certain abrasive articles can utilize not greater than about 75 vol % fillers for the total volume of the bonded abrasive body. According to certain embodiments, the content of fillers in the body cannot be greater than about 50 vol %, not greater than about 40 vol %, not greater than about 30 vol %, not greater than about 20 vol %, or even not greater than about 15 vol %. In particular embodiments, the bonded abrasive body comprises between about 1 vol % and about 75 vol %, such as between about 1 vol % and about 50 vol %, between about 1 vol % and about 20 vol %, or even between about 1 vol % and about 15 vol % fillers for the total volume of the bonded abrasive body. In one instance, the bonded abrasive body can be essentially free of fillers.

The bonded abrasive bodies of embodiments herein can have a particular content of active bond composition. As will be appreciated the active bond composition can be a reaction product formed from a reaction between the active bond composition precursor and certain components of the bonded abrasive body, including for example, abrasive grains, fillers, and bond material. The active bond composition can facilitate chemical bonding between the particulates (e.g., abrasive grains or filler) within the body and the bond material, which may facilitate retention of particulates within the bond material.

In particular, the active bond composition can include distinct phases, which can be disposed in distinct regions of the bonded abrasive body. Moreover, the active bond composition can have a particular composition depending upon the location of the composition. For example, the active bond composition can include a precipitated phase and an interfacial phase. The precipitated phase can be present within the bond material and can be dispersed as a distinct phase throughout the volume of the bond material. The interfacial phase can be disposed at the interface between the particulate material (i.e., abrasive grains and/or fillers) and the bond material. The interfacial phase can extend around a majority of the surface area of the particulate material of the body. While not completely understood, it is theorized that the distinct phases and differences in the composition of the active bond composition are due to the forming processes, particularly liquid phase sintering.

Accordingly, the bond material can be a composite material including a bond phase and a precipitated phase, which are separate phases. The precipitated phase can be made of a composition including at least one element of the active bond composition and at least one element of the bond material. Notably, the precipitated phase can include at least one metal element originally provided in the mixture as the bond material. The precipitated phase can be a metal or metal alloy compound or complex. In particular embodiments, the precipitated phase can include a material selected from the group of materials consisting of titanium, vanadium, chromium, zirconium, hafnium, tungsten, and a combination thereof. In more particular instances, the precipitated phase includes titanium, and may consist essentially of titanium and tin.

The bond phase of the bond material can include a transition metal element, and particularly a metal element included in the original bond material used to form the mixture. As such, the bond phase can be formed of a material selected from the group of metals consisting of copper, tin, silver, molybdenum, zinc, tungsten, iron, nickel, antimony, and a combination thereof. In particular instances, the bond phase can include copper, and may be a copper-based compound or complex. In certain embodiments, the bond phase consists essentially of copper.

The interfacial phase can include at least one element of the active bond composition. Moreover, the interfacial phase can include at least one element of the particulate material. As such, the interfacial phase can be a compound or complex formed through a chemical reaction between the active bond composition and the particulate. Certain interfacial phase materials include carbides, oxides, nitrides, borides, oxynitrides, oxyborides, oxycarbides and a combination thereof. The interfacial phase can include a metal, and more particularly, may be a compound incorporating a metal, such as a metal carbide, metal nitride, metal oxide, metal oxynitride, metal oxyboride, or metal oxycarbide. According to one embodiment, the interfacial phase consists essentially of a material from the group of titanium carbide, titanium nitride, titanium boronitride, titanium aluminum oxide, and a combination thereof.

Moreover, the interfacial phase can have an average thickness of at least about 0.1 microns. However, and more particularly, the interfacial phase can have a varying thickness depending upon the size of the particulate material the interfacial phase overlies. For example, with regard to abrasive grains and/or fillers having an average size of less than 10 microns, the interfacial phase can have a thickness within a range between about 1% to 205 of the average size of the particulate. For particulate material having an average size within a range between about 10 microns and about 50 microns, the interfacial phase can have a thickness within a range between about 1% to about 10% of the average size of the particulate. For particulate material having an average size within a range between about 50 microns and about 500 microns, the interfacial phase can have a thickness within a range between about 0.5% to about 10% of the average size of the particulate. For particulate material having an average size of greater than about 500 microns, the interfacial phase can have a thickness within a range between about 0.1% to about 0.5% of the average size of the particulate.

In accordance with an embodiment, the bonded abrasive body can include at least about 1 vol % of the active bond composition, which includes all phases of the active bond composition, such as the interfacial phase and the precipitate phase, for the total volume of the bond material. In other instances, the amount of active bond composition within the bond can be greater, such at least about 4 vol %, at least about 6 vol %, at least about 10 vol %, at least about 12 vol %, at least about 14 vol %, or even at least about 15 vol %. In particular instances, the bond material contains an amount of active bond composition within the range between about 1 vol % and about 40 vol %, such as between about 1 vol % and 30 vol %, between about 1 vol % and about 25 vol %, between about 4 vol % and about 25 vol %, or between about 6 vol % and about 25 vol %. In some instances, the amount of active bond composition is within a range between about 10 vol % and about 30 vol %, between about 10 vol % and about 25 vol %, or even between about 12 vol % and about 20 vol % of the total volume of the bond material.

The abrasive articles of the embodiments herein may have certain properties. For example, the bonded abrasive body can have a modulus of rupture (MOR) of at least about 2,000 psi, such as at least about 32,000 psi, and more particularly, at least about 4,000 psi.

Moreover, the bonded abrasive body can be utilized in grinding operations wherein the bonded abrasive body is rotated at particular surface speeds. Surface speed refers to the speed of the wheel at the point of contact with the work piece. For example, the bonded abrasive body can be rotated at a speed of at least 1,500 surface feet per minute (sfpm), such as at least about 1,800, such as at least about 2,000 sfpm, at least about 2,500 sfpm, at least about 5,000 sfpm, or even at least 20,000 sfpm. In particular instances, the bonded abrasive body can be rotated at a speed within a range between about 2,000 sfpm and about 15,000 sfpm, such as between about 2,000 sfpm and 20,000 sfpm.

The bonded abrasive body may be suitable for use in various grinding operations including for example plunge grinding operations, creep feed grinding operations, peel grinding operations, flute grinding operations, and the like. In one particular instance, the bonded abrasive body is suitable for use in end mill grinding applications. In other instances, the bonded abrasive body may be useful in thinning of hard and brittle workpieces, including for example, sapphire and quartz materials.

EXAMPLES

Reference is now made to the following examples and Tables 1 and 2, which together with the above descriptions illustrate some embodiments of the invention in a nonlimiting fashion.

Example 1

Test bars were made using a steel mold of size 2.047"× 0.323". The height of the test bar depended on the amount of mix introduced. Diamond abrasive of size U.S. mesh 200/230, procured as MB150 from Worldwide Superabrasives in Florida, were mixed with bond, consisting of bronze with 82/18 by weight of copper/tin, and titanium hydride in the ratio of 85 to 15% by volume. The abrasive to bond ratio was kept at 2.5 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal and attaches itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 37 through 40 of Table 1.

Example 2

Test bars were made using a steel mold of size 2.047"× 0.323". The height of the test bar depended on the amount of mix introduced. Diamond abrasive of size U.S. mesh 200/230, procured as MB150 from Worldwide Superabrasives in Florida, were mixed with bond, consisting of bronze with 67/33 by weight of copper/tin, and titanium hydride in the ratio of 85 to 15% by volume. The abrasive to bond ratio was kept at 2.5 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal and attaches itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly, with other abrasive/bond ratios to make the set of samples reference numbers 33 through 36 of Table 1.

Example 3

Test bars were made using a steel mold of size 2.047"× 0.323". The height of the test bar depended on the amount of mix introduced. Diamond abrasive of size U.S. mesh 200/230, procured as MB150 from Worldwide Superabrasives in Florida, were mixed with bond, consisting of bronze with 60/40 by weight of copper/tin, and titanium hydride in the ratio of 85 to 15% by volume. The abrasive to bond ratio was kept at 2.5 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal and attaches itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 29 through 32 of Table 1.

Example 4

Test bars were made using a steel mold of size 2.047"× 0.323". The height of the test bar depended on the amount of mix introduced. Cubic Boron Nitride abrasives of size U.S. mesh 60/80, procured as CBN AMA from Worldwide Superabrasives in Florida, were mixed with bond, consisting of 67:33 bronze, titanium hydride and tungsten powder from Buffalo Tungsten, New York screened to U.S. mesh 100/120, and in the volume ratio of 39.7%:7.1%:53.3%. The abrasive to bond ratio was kept at 0.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Figure 3:
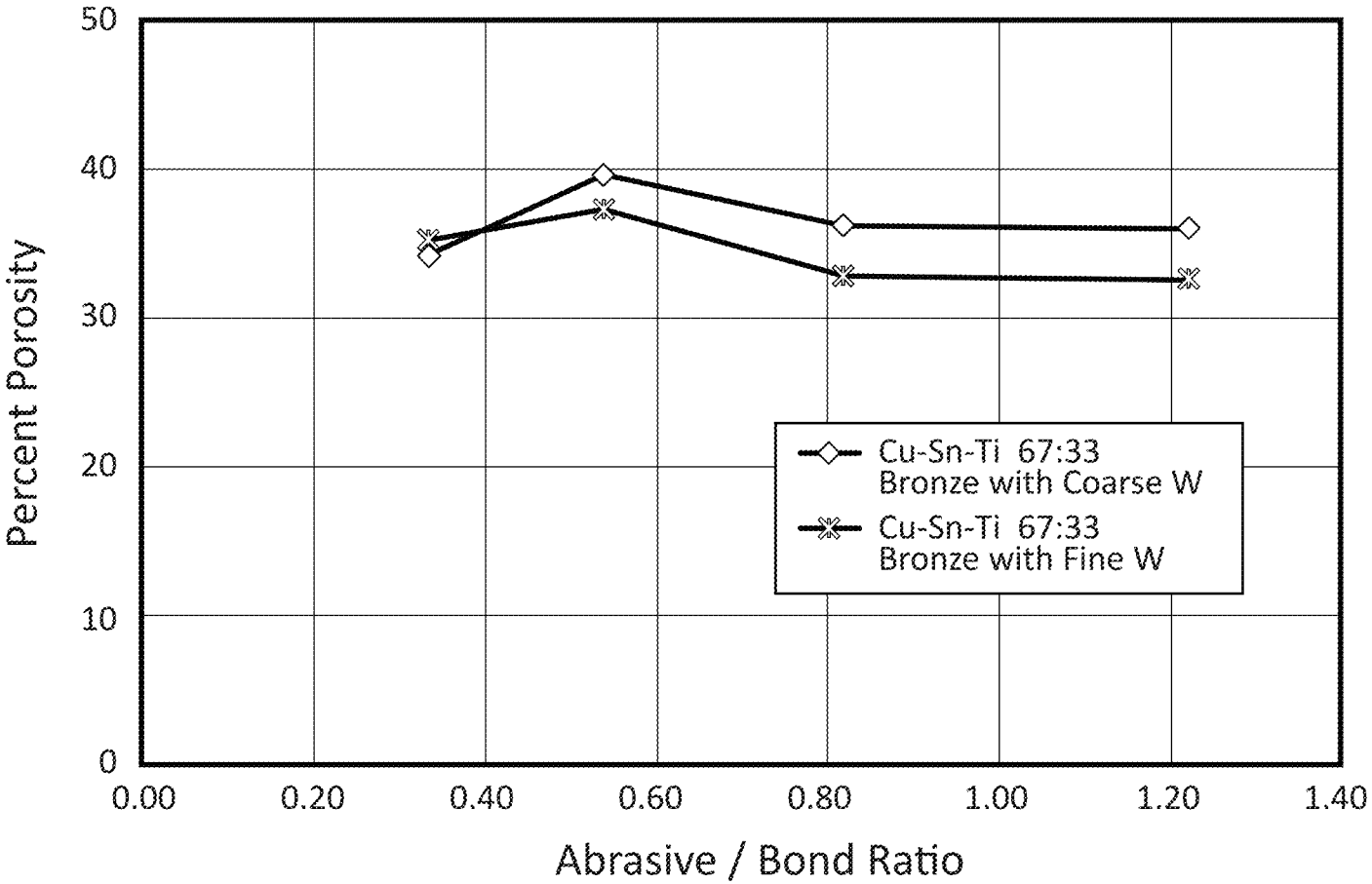
FIG. 3 is a graph showing percent porosity in samples containing cubic Boron Nitride abrasive of size U.S. mesh −60/+80 mesh with bronze and titanium; and, FIG. 4. Is a close-up image showing a porous metal bonded wheel with abrasives and porosity.
Figure 4:
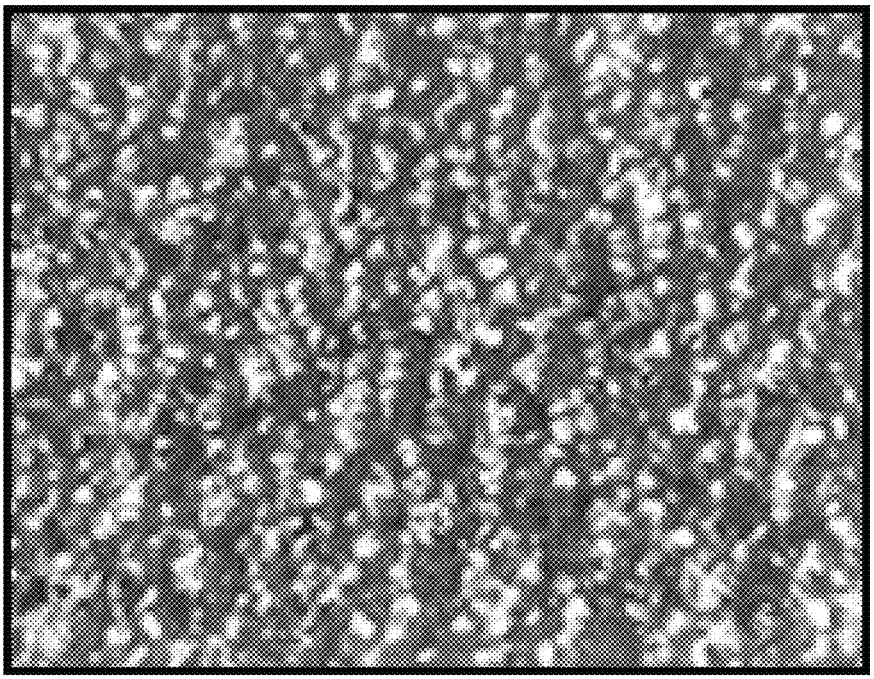

Other compositions were made similarly with other abrasive/bond ratios to make the set of samples reference numbers 162 through 165 of Table 1. FIG. 3 shows percent porosity in samples containing cubic Boron Nitride abrasive of size U.S. mesh −60/+80 mesh with Bronze and titanium. Two different sizes of tungsten were used (−100/+120 mesh and −325 mesh). Even though the braze would shrink by itself, addition of tungsten metal causes it not to shrink leaving higher level of porosity.

Example 5

Test bars were made using a steel mold of size 2.047"× 0.323". The height of the test bar depended on the amount of mix introduced. Cubic Boron Nitride abrasives of size U.S. mesh 60/80, procured as CBN AMA from Worldwide Superabrasives in Florida, were mixed with bond, consisting of 67:33 bronze, titanium hydride and tungsten powder from Buffalo Tungsten, New York screened to U.S. mesh below 325 and in the volume ratio of 39.7%:7.1%:53.3%. The abrasive to bond ratio was kept at 0.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 166 through 169 of Table 1.

Example 6

Test bars were made using a steel mold of size 2.047"× 0.323". The height of the test bar depended on the amount of mix introduced. Diamond abrasives of size U.S. mesh 70/80, procured as WSG500 from Worldwide Superabrasives in Florida, were mixed with bond, consisting of bronze, with 82/18 by weight of copper/tin, and titanium hydride, and in the volume ratio of 85%:15%. The abrasive to bond ratio was kept at 2.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Figure 2:
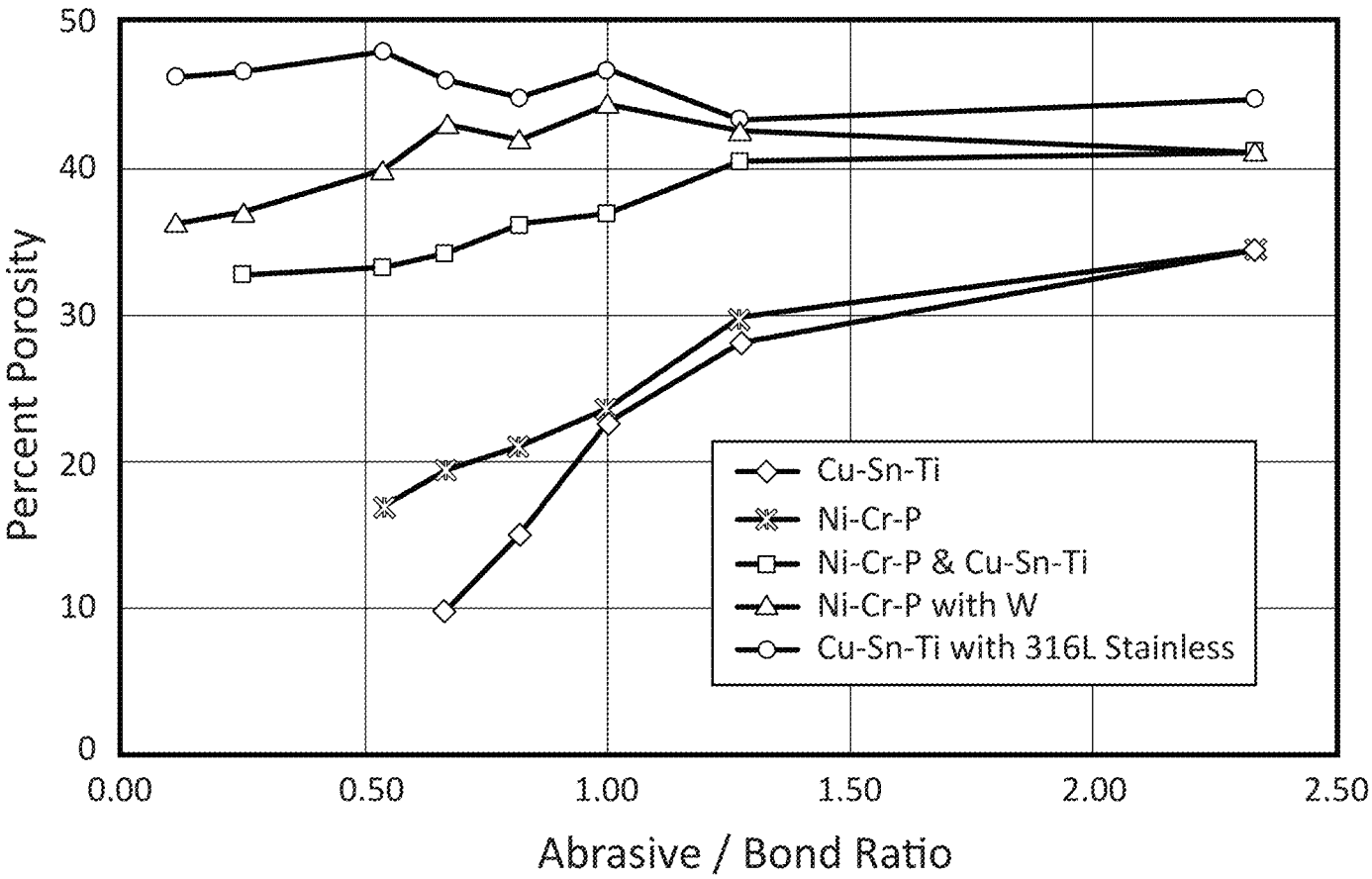
FIG. 2 is a graph showing samples made with WSG500 diamond abrasive of size −70/+80 U.S. mesh together with bond in different proportions.

Other compositions were made similarly with other abrasive/bond ratios to make the set of samples reference numbers 286 through 290 of Table 1. FIG. 2 shows samples made with WSG500 diamond abrasive of size −70/+80 U.S. mesh together with bond in different proportions. The legend shows the bond used which could be a braze alloy powder with metals and metal alloys. While a braze alloy such as Cu—Sn—Ti or Ni—Cr—P results in shrinkage after sintering leading to low porosity levels, a mixture of the two may not result in shrinkage. This result was unexpected, even with low abrasive/bond ratios. Consequently, the porosity remains above 30% for different abrasive/bond ratios.

Example 7

Test bars were made using a steel mold of size 2.047"× 0.323". The height of the test bar depended on the amount of mix introduced. Diamond abrasives of size U.S. mesh 70/80, procured as WSG500 from Worldwide Superabrasives in Florida, were mixed with bond, consisting of BNi7 braze alloy powder only of size −325 mesh. BNi7 consists of nickel, chromium and phosphorous alloyed together. The abrasive to bond ratio was kept at 2.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the eutectic temperature of the alloy. This ensured full melting of the alloy and its flow towards the diamond. The chromium hydride decomposes into titanium and hydrogen at around 700 degrees F. The acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 292 through 297 of Table 1.

Example 8

Test bars were made using a steel mold of size 2.047"× 0.323". The height of the test bar depended on the amount of mix introduced. Diamond abrasives of size U.S. mesh 70/80, procured as WSG500 from Worldwide Superabrasives in Florida, were mixed with bond, consisting of bronze, with 67/33 by weight of copper/tin, and titanium hydride and BNi7 (nickel-chromium-phosphorous) in the volume ratio of 71%:12.7%:16.7%. The abrasive to bond ratio was kept at 2.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. Both titanium and chromium act as active metals and attach themselves to diamond through the formation of their carbides. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 304 through 310 of Table 1.

Example 9

Test bars were made using a steel mold of size 2.047"× 0.323". The height of the test bar depended on the amount of mix introduced. Diamond abrasives of size U.S. mesh 70/80, procured as WSG500 from Worldwide Superabrasives in Florida, were mixed with bond, consisting of BNi7 braze alloy powder and tungsten, both of size −325 mesh. BNi7 consists of nickel, chromium and phosphorous alloyed together. The volume ratio of BNi7 to tungsten was kept at 83.3% to 16.7%. The abrasive to bond ratio was kept at 2.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the eutectic temperature of the alloy. This ensured full melting of the alloy and its flow towards the diamond. The chromium hydride decomposes into titanium and hydrogen at around 700 degrees F. The acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were made similarly with other abrasive/bond ratios to make the set of samples reference numbers 311 through 318 of Table 1.

Example 10

Test bars were made using a steel mold of size 2.047"× 0.323". The height of the test bar depended on the amount of mix introduced. Diamond abrasives of size U.S. mesh 70/80, procured as WSG500 from Worldwide Superabrasives in Florida, were mixed with bond, consisting of bronze, with 82/18 by weight of copper/tin, and titanium hydride and 316L stainless steel powders, and in the volume ratio of 71%:12.7%:16.6%. The abrasive to bond ratio was kept at 2.33 in the powder mixture. An organic binder with an organic solvent was added to the mix. Upon the removal of the solvent and sieving of the mix through a 20-mesh screen, the powders were thoroughly mixed and had the consistency of "mud". A quantity of mix required to make test bars of size 0.110" thickness was introduced into the steel mold and pressed to shape.

The test bar was carefully placed on a graphite material and furnaced in vacuum at a temperature above the liquidus temperature of the alloy. This ensured full melting of the alloy and its flow towards the diamond. The titanium hydride decomposes into titanium and hydrogen at around 700 degrees F. The titanium acts as active metal to attach itself to diamond through the formation of its carbide. Depending on the ratio of abrasive to bond, the test bars shrunk to different extents, leaving porosities of different magnitudes. More than one test bar per composition were made to get average values. Upon cooling, they were measured for dimensions, weights and densities determined. When there was excessive melt and loss of form, densities were measured through Archimedes principle.

Other compositions were similarly made, with other abrasive/bond ratios to make the set of samples reference numbers 319 through 326 of Table 1.

TABLE 1

Porosity measurements on test bars of different metal/metal alloy compositions with abrasives. The sum of abrasives and bond volume percent should add up to 100% before manufacture of the test bars. Porosity is created after the test bars are furnaced in a vacuum.

| | | | | Bond components volume, % | | | |
|---|---|---|---|---|---|---|---|
| Sample reference | Abrasive type | Abrasive size, mesh | Abrasive volume, % | Bronze 82/18 by wt. | Bronze 67/33 by wt. | Bronze 60/40 by wt. | Titanium Hydride |
| 37 | MB150 | 200/230 | 71.4 | 24.3 | | | 4.3 |
| 38 | MB150 | 200/230 | 55.0 | 38.3 | | | 6.8 |
| 39 | MB150 | 200/230 | 38.5 | 52.3 | | | 9.2 |
| 40 | MB150 | 200/230 | 20.0 | 68.0 | | | 12.0 |
| 33 | MB150 | 200/230 | 71.4 | | 24.3 | | 4.3 |
| 34 | MB150 | 200/230 | 55.0 | | 38.3 | | 6.8 |
| 35 | MB150 | 200/230 | 38.5 | | 52.3 | | 9.2 |
| 36 | MB150 | 200/230 | 20.0 | | 68.0 | | 12.0 |
| 29 | MB150 | 200/230 | 71.4 | | | 24.3 | 4.3 |
| 30 | MB150 | 200/230 | 55.0 | | | 38.3 | 6.8 |
| 31 | MB150 | 200/230 | 38.5 | | | 52.3 | 9.2 |
| 32 | MB150 | 200/230 | 20.0 | | | 68.0 | 12.0 |
| 162 | CBN AMX | 60/80 | 25.0 | | 29.8 | | 5.3 |
| 163 | CBN AMX | 60/80 | 35.0 | | 21.3 | | 3.8 |
| 164 | CBN AMX | 60/80 | 45.0 | | 21.3 | | 3.8 |
| 165 | CBN AMX | 60/80 | 55.0 | | 21.3 | | 3.8 |
| 166 | CBN AMX | 60/80 | 25.0 | | 29.8 | | 5.3 |
| 167 | CBN AMX | 60/80 | 35.0 | | 21.3 | | 3.8 |
| 168 | CBN AMX | 60/80 | 45.0 | | 21.3 | | 3.8 |
| 169 | CBN AMX | 60/80 | 55.0 | | 21.3 | | 3.8 |
| 286 | WSG500 | 70/80 | 70.0 | 25.5 | | | 4.5 |
| 287 | WSG500 | 70/80 | 56.0 | 37.4 | | | 6.6 |
| 288 | WSG500 | 70/80 | 50.0 | 42.5 | | | 7.5 |
| 289 | WSG500 | 70/80 | 45.0 | 46.8 | | | 8.3 |
| 290 | WSG500 | 70/80 | 40.0 | 51.0 | | | 9.0 |
| 292 | WSG500 | 70/80 | 70.0 | | | | |
| 293 | WSG500 | 70/80 | 56.0 | | | | |
| 294 | WSG500 | 70/80 | 50.0 | | | | |
| 295 | WSG500 | 70/80 | 45.0 | | | | |
| 296 | WSG500 | 70/80 | 40.0 | | | | |
| 297 | WSG500 | 70/80 | 35.0 | | | | |
| 304 | WSG500 | 70/80 | 70.0 | 21.3 | | | 3.8 |
| 305 | WSG500 | 70/80 | 56.0 | 21.3 | | | 3.8 |
| 306 | WSG500 | 70/80 | 50.0 | 21.3 | | | 3.8 |
| 307 | WSG500 | 70/80 | 45.0 | 21.3 | | | 3.8 |
| 308 | WSG500 | 70/80 | 40.0 | 21.3 | | | 3.8 |
| 309 | WSG500 | 70/80 | 35.0 | 21.3 | | | 3.8 |
| 310 | WSG500 | 70/80 | 20.0 | 34.0 | | | 6.0 |
| 311 | WSG500 | 70/80 | 70.0 | | | | |
| 312 | WSG500 | 70/80 | 56.0 | | | | |
| 313 | WSG500 | 70/80 | 50.0 | | | | |
| 314 | WSG500 | 70/80 | 45.0 | | | | |
| 315 | WSG500 | 70/80 | 40.0 | | | | |
| 316 | WSG500 | 70/80 | 35.0 | | | | |
| 317 | WSG500 | 70/80 | 20.0 | | | | |
| 318 | WSG500 | 70/80 | 10.0 | | | | |
| 319 | WSG500 | 70/80 | 70.0 | 21.3 | | | 3.8 |
| 320 | WSG500 | 70/80 | 56.0 | 21.3 | | | 3.8 |
| 321 | WSG500 | 70/80 | 50.0 | 21.3 | | | 3.8 |
| 322 | WSG500 | 70/80 | 45.0 | 21.3 | | | 3.8 |
| 323 | WSG500 | 70/80 | 40.0 | 21.3 | | | 3.8 |
| 324 | WSG500 | 70/80 | 35.0 | 21.3 | | | 3.8 |
| 325 | WSG500 | 70/80 | 20.0 | 34.0 | | | 6.0 |
| 326 | WSG500 | 70/80 | 10.0 | 29.8 | | | 5.3 |

| | Bond components volume, % | | | | | |
|---|---|---|---|---|---|---|
| Sample reference | Tungsten 100/+120 mesh | Tungsten 325 mesh | Ni-Cr-P BNi7 braze 325 mesh | 316L Stainless 325 mesh | Abrasive/ Bond volume | Porosity % |
| 37 | | | | | 2.50 | 38.7 |
| 38 | | | | | 1.22 | 26.2 |
| 39 | | | | | 0.63 | 1.1 |
| 40 | | | | | 0.25 | 2.2 |
| 33 | | | | | 2.50 | 37.2 |
| 34 | | | | | 1.22 | 22.9 |
| 35 | | | | | 0.63 | 1.0 |

TABLE 1-continued

Porosity measurements on test bars of different metal/metal alloy compositions with abrasives. The sum of abrasives and bond volume percent should add up to 100% before manufacture of the test bars. Porosity is created after the test bars are furnaced in a vacuum.

| | | | | | | |
|---|---|---|---|---|---|---|
| 36 | | | | | 0.25 | 0.1 |
| 29 | | | | | 2.50 | 34.2 |
| 30 | | | | | 1.22 | 25.8 |
| 31 | | | | | 0.63 | 6.5 |
| 32 | | | | | 0.25 | 3.1 |
| 162 | 40.0 | | | | 0.33 | 34.2 |
| 163 | 40.0 | | | | 0.54 | 39.6 |
| 164 | 30.0 | | | | 0.82 | 36.2 |
| 165 | 20.0 | | | | 1.22 | 36.0 |
| 166 | | 40.0 | | | 0.33 | 35.2 |
| 167 | | 40.0 | | | 0.54 | 37.3 |
| 168 | | 30.0 | | | 0.82 | 32.8 |
| 169 | | 20.0 | | | 1.22 | 32.6 |
| 286 | | | | | 2.33 | 34.3 |
| 287 | | | | | 1.27 | 28.1 |
| 288 | | | | | 1.00 | 22.6 |
| 289 | | | | | 0.82 | 15.0 |
| 290 | | | | | 0.67 | 9.8 |
| 292 | | | 30.0 | | 2.33 | 34.5 |
| 293 | | | 44.0 | | 1.27 | 29.8 |
| 294 | | | 50.0 | | 1.00 | 23.6 |
| 295 | | | 55.0 | | 0.82 | 21.0 |
| 296 | | | 60.0 | | 0.67 | 19.4 |
| 297 | | | 65.0 | | 0.54 | 16.9 |
| 304 | | | 5.0 | | 2.33 | 41.2 |
| 305 | | | 19.0 | | 1.27 | 40.5 |
| 306 | | | 25.0 | | 1.00 | 36.9 |
| 307 | | | 30.0 | | 0.82 | 36.1 |
| 308 | | | 35.0 | | 0.67 | 34.2 |
| 309 | | | 40.0 | | 0.54 | 33.3 |
| 310 | | | 40.0 | | 0.25 | 32.8 |
| 311 | | 5.0 | 25.0 | | 2.33 | 41.1 |
| 312 | | 19.0 | 25.0 | | 1.27 | 42.6 |
| 313 | | 25.0 | 25.0 | | 1.00 | 44.4 |
| 314 | | 30.0 | 25.0 | | 0.82 | 42.0 |
| 315 | | 35.0 | 25.0 | | 0.67 | 43.1 |
| 316 | | 40.0 | 25.0 | | 0.54 | 39.9 |
| 317 | | 40.0 | 40.0 | | 0.25 | 37.0 |
| 318 | | 55.0 | 35.0 | | 0.11 | 36.3 |
| 319 | | | | 5.0 | 2.33 | 44.7 |
| 320 | | | | 19.0 | 1.27 | 43.3 |
| 321 | | | | 25.0 | 1.00 | 46.7 |
| 322 | | | | 30.0 | 0.82 | 44.8 |
| 323 | | | | 35.0 | 0.67 | 46.0 |
| 324 | | | | 40.0 | 0.54 | 48.0 |
| 325 | | | | 40.0 | 0.25 | 46.6 |
| 326 | | | | 55.0 | 0.11 | 46.2 |

Example 11

A cylindrical puck, using a copper cup of diameter around 0.920" and height of 0.200" with a wall thickness of 0.010", was made. The puck consisted of cubic Boron Nitride abrasives of size U.S. mesh −80/+100 mesh, procured as AMB from Worldwide Superabrasives in Florida, Bubble Alumina of 1 to 2 mm size and 85% porosity from Greystar and a bond, consisting of copper, tin and titanium alloy in the weight ratio of 54, 36 and 10% by weight respectively. The ratio of abrasives to bubble alumina to bond was respectively 7:49:44 by volume. This resulted in an abrasive to bond ratio of 0.16 in the powder mixture and abrasive plus filler over bond ratio of 1.27. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with abrasive/bond ratios ranging from 0.48 to 0.80 as shown in Table 2 resulting in sample reference numbers 391 through 394.

Example 12

A cylindrical puck using a copper cup of diameter around 0.920" and height of 0.200" with a wall thickness of 0.010" was made. The puck consisted of cubic Boron Nitride abrasives of size U.S. mesh −80/+100 mesh, procured as AMB from Worldwide Superabrasives in Florida, Bubble Alumina of 1 to 2 mm size and 85% porosity from Greystar and a bond, consisting of copper, tin and titanium alloy with iron in the volume ratio of 7:49:44. The weight ratio of copper:tin:titanium in the alloy was 54:36:10. Of the 44% by volume of bond, the alloy was 25% and iron 19%. The iron was of size −50/+100 U.S. mesh. The abrasive to bond ratio resulted in 0.16 in the powder mixture and the abrasive plus filler to bond ratio of 1.27. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with abrasive/bond ratios ranging from 0.48 to 0.80 as shown in Table 2 on sample reference numbers 404 through 406. Both had the same abrasive plus filler to bond ratio of 1.27.

Example 13

A cylindrical puck using similar copper cups as in Example 11 was made with a different bond composition. The puck consisted of cubic Boron Nitride abrasives of size U.S. mesh −80/+100 mesh, procured as AMB from Worldwide Superabrasives in Florida, and a bond, consisting of copper, tin, and titanium alloy with iron. The copper-tin-titanium alloy had a weight ratio of 54-36-10 by weight. The ratio of abrasives to bond was 56 to 44 by volume for an abrasive/bond ratio of 1.27. Within the 44% of the bond, there was 25% of the alloy and 19% of iron. The iron had a size of −50/+100 U.S. mesh. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with iron powders of −100/+325 U.S. mesh and −325 U.S. mesh, as shown in Table 2 on sample reference numbers 407 through 409. The abrasive bond ratio in all three compositions were 1.27.

Example 14

A cylindrical puck using similar copper cups as in Example 11 was made with a different bond composition. The puck consisted of Cubic Boron Nitride abrasives of size U.S. mesh −80/+100 mesh, procured as AMB from Worldwide Superabrasives in Florida, and a bond, consisting of copper, tin, and titanium alloy with iron. The copper-tin-titanium alloy had a weight ratio of 54-36-10 by weight. The ratio of abrasives to bond was 56 to 44 by volume for an abrasive/bond ratio of 1.27. Within the 44% of the bond, there was 20% of the alloy and 24% of iron. The iron had a size of −50/+100 U.S. mesh. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with other alloy and iron ratios as shown in Table 2 on sample reference numbers 411 through 413. The abrasive bond ratio in all three compositions were 1.27.

Example 15

A cylindrical puck using similar copper cups as in Example 11 was made with a different bond composition. The puck consisted of Cubic Boron Nitride abrasives of size U.S. mesh −80/+100 mesh, procured as AMB from Worldwide Superabrasives in Florida, and a bond, consisting of copper, tin, and titanium alloy with iron. The copper-tin-titanium alloy had a weight ratio of 70-21-9 by weight. The ratio of abrasives to bond was 56 to 44 by volume for an abrasive/bond ratio of 1.27. Within the 44% of the bond, there was 20% of the alloy and 24% of iron. The iron had a size of −50/+100 U.S. mesh. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with other alloy and iron ratios as shown in Table 2 on sample reference numbers 414 through 416. The abrasive bond ratio in all three compositions were 1.27.

Example 16

A cylindrical puck using similar copper cups as in Example 11 was made with a different bond composition. The puck consisted of Diamond abrasives of size U.S. mesh −80/+100 mesh, procured as WWS200 from Worldwide Superabrasives in Florida, and a bond, consisting of copper, tin, and titanium alloy with iron. The copper-tin-titanium alloy had a weight ratio of 54-36-10 by weight. The ratio of abrasives to bond was 56 to 44 by volume for an abrasive/bond ratio of 1.27. Within the 44% of the bond, there was 25% of the alloy and 19% of iron. The iron had a size of −50/+100 U.S. mesh. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with larger diamonds such as −50/+60 U.S. mesh procured as WSG500 from Worldwide abrasives also and −20/+25 U.S. mesh procured as WSG200 as shown in Table 2 on sample reference numbers 417 through 419. The abrasive bond ratio in all three compositions were 1.27.

Example 17

A cylindrical puck using similar copper cups as in Example 11 was made with a different bond composition. The puck consisted of Aluminum Oxide abrasives of size 54 U.S. mesh, procured as grit blast media from Grainger, and a bond, consisting of copper, tin, and titanium alloy with iron. The copper-tin-titanium alloy had a weight ratio of 54-36-10 by weight. The ratio of abrasives to bond was 56 to 44 by volume for an abrasive/bond ratio of 1.27. Within the 44% of the bond, there was 25% of the alloy and 19% of iron. The iron had a size of −50/+100 U.S. mesh. An organic binder with an organic solvent was added to the mix. The mix was used to fill the cup. After drying the cup to remove the solvent, the puck had sufficient strength to be handled. It was furnaced in vacuum at a temperature above the liquidus temperature of the alloy. The furnaced puck was measured for porosity after subtracting the copper cup volume.

Other compositions were made similarly with iron powders of −100/+325 U.S. mesh and −325 U.S. mesh, as shown in Table 2 on sample reference numbers 407 through 409. The abrasive bond ratio in all three compositions were 1.27.

Table 2, below, refers to the pucks made in copper sups for Examples 11 through 17. Porosity of the various compositions are measured in a manner similar to the test bars of Table 1. The volume percents of abrasive, bond and filler, if any, should add up to 100%.

| | | | | Bond components volume, % | | | | | | | | |
|---|---|---|---|---|---|---|---|---|---|---|---|---|
| Sample reference | Abrasive type | Abrasive size, mesh | Abrasive volume, % | Cu-Sn-Ti 54/36/10 by wt. | Cu-Sn-Ti 70/21/9 by wt. | 50/100 Iron mesh | Iron 100/325 mesh 100/+120 mesh | Iron - 325 mesh 325 mesh | Abrasive/ Bond volume | Filler, Bubble Alumina 1-2 mm | Bond (Abrasive+ Filler)/ volume | Porosity, % |
| 391 | CBN-AMB | 80/100 | 7.0 | 44.0 | | | | | 0.16 | 49.00 | 1.27 | 47.8 |
| 392 | CBN-AMB | 80/100 | 21.0 | 44.0 | | | | | 0.48 | 35.00 | 1.27 | 47.8 |
| 393 | CBN-AMB | 80/100 | 35.0 | 44.0 | | | | | 0.80 | 21.00 | 1.27 | 47.4 |
| 394 | CBN-AMB | 80/100 | 7.0 | 44.0 | | | | | 0.16 | 49.00 | 1.27 | 47.2 |
| 404 | CBN-AMB | 80/100 | 7.0 | 25.0 | | 19.0 | | | 0.16 | 49.00 | 1.27 | 43.1 |
| 405 | CBN-AMB | 80/100 | 21.0 | 25.0 | | 19.0 | | | 0.48 | 35.00 | 1.27 | 39.6 |
| 406 | CBN-AMB | 80/100 | 35.0 | 25.0 | | 19.0 | | | 0.80 | 21.00 | 1.27 | 54.7 |
| 407 | CBN-AMB | 80/100 | 56.0 | 25.0 | | 19.0 | | | 1.27 | 0.00 | 1.27 | 48.8 |
| 408 | CBN-AMB | 80/100 | 56.0 | 25.0 | | | 19.0 | | 1.27 | 0.00 | 1.27 | 52.8 |
| 409 | CBN-AMB | 80/100 | 56.0 | 25.0 | | | | 19.0 | 1.27 | 0.00 | 1.27 | 52.0 |
| 411 | CBN-AMB | 80/100 | 56.0 | 20.0 | | 24.0 | | | 1.27 | 0.00 | 1.27 | 49.7 |
| 412 | CBN-AMB | 80/100 | 56.0 | 25.0 | | 19.0 | | | 1.27 | 0.00 | 1.27 | 48.8 |
| 413 | CBN-AMB | 80/100 | 56.0 | 30.0 | | 14.0 | | | 1.27 | 0.00 | 1.27 | 44.3 |
| 414 | CBN AMX | 60/80 | 56.0 | | 20.0 | 24.0 | | | 1.27 | 0.00 | 1.27 | 47.9 |
| 415 | CBN AMX | 60/80 | 56.0 | | 25.0 | 19.0 | | | 1.27 | 0.00 | 1.27 | 46.5 |
| 416 | CBN AMX | 60/80 | 56.0 | | 30.0 | 14.0 | | | 1.27 | 0.00 | 1.27 | 52.3 |
| 417 | WWS200 | 80/100 | 56.0 | 25.0 | | 19.0 | | | 1.27 | 0.00 | 1.27 | 50.8 |
| 418 | WSG500 | 50/60 | 56.0 | 25.0 | | 19.0 | | | 1.27 | 0.00 | 1.27 | 44.5 |
| 419 | WSG200 | 20/25 | 56.0 | 25.0 | | 19.0 | | | 1.27 | 0.00 | 1.27 | 46.9 |
| 395 | Alumina | 54 grit | 56.0 | 25.0 | | 19.0 | | | 1.27 | 0.00 | 1.27 | 47.0 |
| 396 | Alumina | 54 grit | 56.0 | 25.0 | | | 19.0 | | 1.27 | 0.00 | 1.27 | 47.5 |
| 397 | Alumina | 54 grit | 56.0 | 25.0 | | | | 19.0 | 1.27 | 0.00 | 1.27 | 49.1 |

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An abrasive article comprising:

a body comprising abrasive grains contained within a bond material comprising a metal or metal alloy, wherein the body comprises a ratio, ($V_{AG}/V_{BM}$), of volume of abrasives ($V_{AG}$) to volume of bond ($V_{BM}$), of between 0.25 and 1.27, wherein ($V_{AG}$) is a volume percent of abrasive grains within the total volume of the body, ($V_{BM}$) is the volume percent of bond within the total volume of the body, wherein the body has 32.8% to 40.5% porosity, and, wherein the bond material comprises at least 1% by volume of an active bond composition of the total volume of the bond, a portion of which is at the interface of the abrasive grains and the bond material, and wherein the bond material comprises a braze alloy of a mixture of nickel/chromium/phosphorous and copper/tin/titanium, and wherein the abrasive grains have an aspect ratio of not greater than about 3:1, wherein aspect ratio is defined as a ratio of the dimensions, length:width.

2. The abrasive article of claim 1, wherein a portion of the active bond composition within the bond material surrounds a majority of the surface area of the abrasive grains at the interface between the abrasive grains and the bond material.

3. The abrasive article of claim 1, wherein the abrasive grains comprise an inorganic material selected from the group of materials consisting of carbides, oxides, nitrides, and a combination thereof.

4. The abrasive article of claim 1, wherein the bond system of the abrasive article could also comprise intermetallics.

5. The abrasive article of claim 1, wherein the abrasive grains comprise a coating.

6. The abrasive article of claim 5, wherein the coating comprises a metal or metal alloy.

7. An abrasive article comprising:

a body comprising abrasive grains contained within a bond material comprising a metal or metal alloy, wherein the body comprises a ratio ($V_{AG}/V_{BM}$) between 0.11 and about 1.27, wherein ($V_{AG}$) is a volume percent of abrasive grains within the total volume of the body, ($V_{BM}$) is the volume percent of bond within the total volume of the body, wherein the body has 36.3% to 44.4% porosity, wherein the bond material comprises at least 1% by volume of an active bond composition of the total volume of the bond, a portion of which is at the interface of the abrasive grains and the bond material, and wherein the bond material comprises a braze alloy of a mixture of nickel/chromium/phosphorous and tungsten or molybdenum, and wherein the abrasive grains have an aspect ratio of not greater than about 3:1, wherein aspect ratio is defined as a ratio of the dimensions, length:width.

8. The abrasive article of claim 7, wherein a portion of the active bond composition within the bond material surrounds a majority of the surface area of the abrasive grains at the interface between the abrasive grains and the bond material.

9. The abrasive article of claim 7, wherein the abrasive grains comprise an inorganic material selected from the group of materials consisting of carbides, oxides, nitrides, and a combination thereof.

10. The abrasive article of claim 7, wherein the bond system of the abrasive article could also comprise intermetallics.

11. The abrasive article of claim 7, wherein the abrasive grains comprise a coating.

12. The abrasive article of claim 11, wherein the coating comprises a metal or metal alloy.

13. An abrasive article comprising:

a body comprising abrasive grains contained within a bond material comprising a metal or metal alloy, wherein the body comprises a ratio, ($V_{AG}/V_{BM}$), of volume of abrasives ($V_{AG}$) to volume of bond ($V_{BM}$), of between 0.11 and 1.27, wherein ($V_{AG}$) is a volume percent of abrasive grains within the total volume of the body, ($V_{BM}$) is the volume percent of bond within the total volume of the body, wherein the body has 43.3% to 48.0% porosity, and, wherein the bond material comprises at least 1% by volume of an active bond composition of the total volume of the bond, a portion of which is at the interface of the abrasive grains and the bond material, and wherein the bond material comprises a braze alloy of a mixture of copper/tin/titanium and 316L stainless steel.

14. The abrasive article of claim 13, wherein a portion of the active bond composition within the bond material surrounds a majority of the surface area of the abrasive grains at the interface between the abrasive grains and the bond material.

15. The abrasive article of claim 13, wherein the abrasive grains comprise an inorganic material selected from the group of materials consisting of carbides, oxides, nitrides, and a combination thereof.

16. The abrasive article of claim 13, wherein the abrasive grains have an aspect ratio of not greater than about 3:1, wherein aspect ratio is defined as a ratio of the dimensions, length:width.

17. The abrasive article of claim 13, wherein the bond system of the abrasive article could also comprise intermetallics.

18. The abrasive article of claim 13, wherein the abrasive grains comprise a coating.

19. The abrasive article of claim 18, wherein the coating comprises a metal or metal alloy.

20. An abrasive article comprising:

a body comprising abrasive grains contained within a bond material comprising a metal or metal alloy, wherein the body comprises a ratio, ($V_{AG}/V_{BM}$), of volume of abrasives ($V_{AG}$) to volume of bond ($V_{BM}$), of between 0.16 and 0.80, wherein ($V_{AG}$) is a volume percent of abrasive grains within the total volume of the body, ($V_{BM}$) is the volume percent of bond within the total volume of the body, wherein the body has 43.1% to 54.7% porosity, and, wherein the bond material comprises at least 1% by volume of an active bond composition of the total volume of the bond, a portion of which is at the interface of the abrasive grains and the bond material, and wherein the bond material comprises a braze alloy of a mixture of copper/tin/titanium and iron, and wherein the abrasive grains have an aspect ratio of not greater than about 3:1, wherein aspect ratio is defined as a ratio of the dimensions, length:width.

21. The abrasive article of claim 20, wherein a portion of the active bond composition within the bond material surrounds a majority of the surface area of the abrasive grains at the interface between the abrasive grains and the bond material.

22. The abrasive article of claim 20, wherein the abrasive grains comprise an inorganic material selected from the group of materials consisting of carbides, oxides, nitrides, and a combination thereof.

23. The abrasive article of claim 20, wherein the abrasive grains have an aspect ratio of not greater than about 3:1, wherein aspect ratio is defined as a ratio of the dimensions, length:width.

24. The abrasive article of claim 20, wherein the bond system of the abrasive article could also comprise intermetallics.

25. The abrasive article of claim 20, wherein the abrasive grains comprise a coating.

26. The abrasive article of claim 25, wherein the coating comprises a metal or metal alloy.

* * * * *